US006492772B1

(12) United States Patent
Takeuchi

(10) Patent No.: US 6,492,772 B1
(45) Date of Patent: Dec. 10, 2002

(54) HIGH PRESSURE DISCHARGE LAMP, HIGH PRESSURE DISCHARGE LAMP ELECTRODE, METHOD OF PRODUCING THE HIGH PRESSURE DISCHARGE LAMP ELECTRODE, AND ILLUMINATION DEVICE AND IMAGE DISPLAY APPARATUS RESPECTIVELY USING THE HIGH PRESSURE DISCHARGE LAMPS

(75) Inventor: Nobuyoshi Takeuchi, Hirakata (JP)

(73) Assignee: Matsushita Electric Industrial Co., Ltd., Osaka-fu (JP)

( * ) Notice: Subject to any disclaimer, the term of this patent is extended or adjusted under 35 U.S.C. 154(b) by 0 days.

(21) Appl. No.: 09/495,660

(22) Filed: Feb. 1, 2000

(30) Foreign Application Priority Data

Feb. 10, 1999 (JP) ..... 11-032382

(51) Int. Cl.[7] ..... H01J 61/06
(52) U.S. Cl. ..... 313/633; 313/628; 313/631
(58) Field of Search ..... 313/633, 632, 313/344, 628, 631; 355/53

(56) References Cited

U.S. PATENT DOCUMENTS

| | | | | |
|---|---|---|---|---|
| 3,067,357 A | | 12/1962 | Fridrich | |
| 4,002,940 A | | 1/1977 | Ekkelboom et al. | |
| 5,001,397 A | | 3/1991 | Der Kinderen | |
| 5,357,167 A | | 10/1994 | Mathews et al. | |
| 5,629,585 A | | 5/1997 | Altmann et al. | |
| 5,742,125 A | | 4/1998 | Ruigrok | |
| 5,864,388 A | * | 1/1999 | Shima et al. | 355/53 |
| 6,060,828 A | | 5/2000 | Vollkommer et al. | |

FOREIGN PATENT DOCUMENTS

| | | |
|---|---|---|
| DE | 33 05 468 | 8/1984 |
| EP | 917 180 | 5/1999 |
| GB | 2 064 211 | 6/1981 |
| JP | 61165662 | 10/1987 |
| JP | 294352 | 4/1990 |
| JP | 689699 | 3/1994 |
| JP | 7-272679 | 10/1995 |
| JP | 1092377 | 9/1996 |
| JP | 8-273596 | 10/1996 |
| JP | 9-165641 | 6/1997 |
| JP | 10-092377 | 4/1998 |
| JP | 10092377 | 4/1998 |
| JP | 11307046 | 11/1999 |

* cited by examiner

*Primary Examiner*—Vip Patel
*Assistant Examiner*—Ken A. Berck
(74) *Attorney, Agent, or Firm*—Price and Gess

(57) ABSTRACT

A high pressure discharge lamp has a pair of electrodes in a discharge tube. Each electrode includes a coil and an electrode rod with a tip, the coil being set around the electrode rod near the tip. The tip of the electrode rod and an adjacent portion of the coil are fused together during the initial discharge. To be more specific, the coil covers the electrode rod near the tip, with the tip of the electrode rod being left uncovered and a length of the tip being ΔL that satisfies an inequality $1/50*R3 \leqq \Delta L \leqq 1/5*R3$ where R3 is an outer diameter of the coil adjacent to the tip. Alternatively, the electrode can be first formed before being set in the discharge tube, by integrally melting the tip of the electrode rod and the adjacent portion of the coil using, for example, a plasma or laser.

21 Claims, 11 Drawing Sheets

Fig. 7

| ΔL | 0 | 0.015 | 0.02 | 0.024 | 0.03 | 0.04 | 0.048 | 0.06 | 0.08 | 0.12 | 0.15 | 0.24 | 0.3 | 0.4 |
|---|---|---|---|---|---|---|---|---|---|---|---|---|---|---|
| ΔL/R3 | 0 | 1/80 | 1/60 | 1/50 | 1/40 | 1/30 | 1/25 | 1/20 | 1/15 | 1/10 | 1/8 | 1/5 | 1/4 | 1/3 |
| ΔA | -0.25 | -0.20 | -0.17 | -0.15 | -0.12 | -0.08 | -0.01 | 0.02 | 0.04 | 0.10 | 0.13 | 0.15 | 0.21 | 0.32 |
| ASSESSMENT | × | × | × | ○ | ○ | ○ | ○ | ○ | ○ | ○ | ○ | ○ | × | × |

Fig. 8

| ΔL | 0 | 0.018 | 0.023 | 0.028 | 0.035 | 0.047 | 0.056 | 0.07 | 0.093 | 0.14 | 0.175 | 0.28 | 0.35 | 0.47 |
|---|---|---|---|---|---|---|---|---|---|---|---|---|---|---|
| ΔL/R3 | 0 | 1/80 | 1/60 | 1/50 | 1/40 | 1/30 | 1/25 | 1/20 | 1/15 | 1/10 | 1/8 | 1/5 | 1/4 | 1/3 |
| ΔA | -0.27 | -0.21 | -0.18 | -0.15 | -0.13 | -0.10 | -0.03 | 0.00 | 0.04 | 0.08 | 0.12 | 0.14 | 0.22 | 0.31 |
| ASSESSMENT | × | × | × | ○ | ○ | ○ | ○ | ○ | ○ | ○ | ○ | ○ | × | × |

Fig. 12

| | TOTAL OF IMPURITY CONTENTS (ppm) | | | | | | | |
|---|---|---|---|---|---|---|---|---|
| | 20 | 25 | 30 | 35 | 40 | 45 | 50 | 60 |
| LEVEL OF BLACKENING | ◎ | ◎ | ○ | ○ | ○ | ▲ | ▲ | × |

Fig. 13

| | Fe CONTENT (ppm) | | | | | | | |
|---|---|---|---|---|---|---|---|---|
| | 5 | 10 | 15 | 20 | 25 | 30 | 35 | 40 |
| LEVEL OF BLACKENING | ◎ | ◎ | ○ | ○ | ▲ | ▲ | × | × |

Fig. 14

| | K CONTENT (ppm) | | | | | | | |
|---|---|---|---|---|---|---|---|---|
| | 5 | 10 | 12 | 15 | 20 | 25 | 30 | 35 |
| LEVEL OF BLACKENING | ◎ | ◎ | ○ | ▲ | × | × | × | × |

HIGH PRESSURE DISCHARGE LAMP, HIGH PRESSURE DISCHARGE LAMP ELECTRODE, METHOD OF PRODUCING THE HIGH PRESSURE DISCHARGE LAMP ELECTRODE, AND ILLUMINATION DEVICE AND IMAGE DISPLAY APPARATUS RESPECTIVELY USING THE HIGH PRESSURE DISCHARGE LAMPS

BACKGROUND OF THE INVENTION (1) Field of the Invention

The present invention relates to a high pressure discharge lamp that is used in general lighting fixtures and optical instruments, and also relates to a high pressure discharge lamp electrode, a method of producing the high pressure discharge lamp electrode, and an illumination device and an image display apparatus respectively using the high pressure discharge lamps.

(2) Description of Related Art

Conventionally, a light source and a concave reflecting mirror are usually formed in one piece as an illumination device that is provided in an image display apparatus, such as a liquid crystal projector. As a light source of the illumination device, a high pressure mercury lamp with a short arc, which is close to a point light source, has been used. The high pressure mercury lamp has advantages, such as an excellent luminous efficiency, high intensity, favorable balance of red, blue, and green in emitted light, and long life. As one example of a high pressure discharge lamp, a conventional high pressure mercury lamp is described below.

In general, a high pressure mercury lamp is provided with a discharge tube having a light-emitting part and a pair of sealing parts. The light-emitting part includes a pair of electrodes. The light-emitting part is filled with mercury as light-emitting material, a rare gas such as argon gas for starting-up, and halogen substance that facilitates a halogen cycle during lamp operation.

FIG. 1 shows an example of an electrode that has been used in this conventional high pressure mercury lamp. As shown in this figure, a conventional electrode 901 is composed of a coil 903 and an electrode rod 902 both made of tungsten, with the coil 903 being set at a discharge side end of the electrode rod 902. The coil 903 has a closely-wound double-layered structure. Specifically, a first layer 903*a* has 15 turns while a second layer 903*b* consisting of 8 turns is wound around the first layer 903*a*.

When this high pressure mercury lamp is lit up, a temperature of the end of the electrode considerably increases. As a result of this high temperature of the electrode end, even though halogen substance has been inserted in the light-emitting part, tungsten used for making the electrode is deposited on an inner surface of the discharge tube, causing blackening. This gives rise to a problem that a lamp life is shortened.

The techniques for preventing blackening from occurring to the discharge tube are disclosed in U.S. Pat. No. 5,357,167 and Japanese Laid-Open Patent Application No. 10-92377.

FIG. 2 shows an electrode disclosed in U.S. Pat. No. 5,357,167. As shown in this figure, an electrode 911 is composed of an electrode rod 912, a sleeve 913, and an electrode end 914. The electrode rod 912 and the sleeve 913 are both made of refractory metal, such as tungsten and molybdenum. The sleeve 913 is positioned on the electrode rod 912. The hemisphere-shaped electrode end 914 is formed by melting the metals respectively forming the electrode 912 and the sleeve 913 by heat, thereby being integrally joined to both the electrode rod 912 and the sleeve 913. With the construction disclosed in this reference, a heat capacity of the end of the electrode is increased. Therefore, blackening caused by the deposition of refractory metal, such as tungsten, is prevented by suppressing overheating of the end of the electrode. Also, the heat flow of the electrode rod 912 is controlled owing to the small diameter of the electrode rod 912, so that the temperature of the electrode end 914 can be prevented from falling below the temperature required for discharge.

Meanwhile, Japanese Laid-Open Patent Application No. 10-92377 discloses an electrode (referred to as the "electrode 921") as shown in FIG. 3 and a method of producing the same. More specifically, the electrode 921 includes an electrode rod 922 that is made of tungsten and partially covered with a covering material 923. Here, the discharge side tip of the electrode rod 922 is left uncovered. With this state, a discharge takes place between the end of the electrode rod 922 and a discharge electrode (not shown in FIG. 3) under an inert gas atmosphere. As a result of this discharge, the tip of the electrode rod 922 that was left uncovered is melted. Then, the melted part that has solidified in the shape of a rough sphere or a pear is shaped by polishing or grinding, so that an electrode end 924 is formed. In this way, the electrode 921 shown in FIG. 3 has been produced.

SUMMARY OF THE INVENTION

However, after an acute analysis, the inventor of the present invention found that various problems could arise if actually producing electrodes using the methods disclosed in the cited references. The inventor further conducted an analysis, and then came up with the present invention that addresses the various problems. The problems found through the analysis by the inventor and details how the inventor came up with the present invention are explained below.

The inventor first employed the method where an electrode rod is covered with a sleeve or coil and the end of the electrode rod is melted, as disclosed in the cited references. As a result, the shape of the solidified end of the electrode rod was unstable in most cases and had to be machined to form an appropriate shape through such as polishing and grinding. Additionally, the inventor found that blackening could not be adequately prevented in an actual use.

To be more specific, the inventor had the end of the electrode rod melted, with the tip of the rod being left uncovered with the sleeve or coil serving as the covering material. As a result, the shape of the solidified end of the electrode rod was not suitable for the actual use. In most cases, the solidified end needed to be machined to be formed into an appropriate shape through such as polishing or grinding as described in Japanese Laid-Open Patent Application No. 10-92377.

Meanwhile, the inventor conducted another experiment where the melting process was carried out, with the coil that covered the electrode rod being extended comparatively longer to the discharge side than the end of the electrode rod. In this case, the inventor found that there might be a case where blackening could not adequately be prevented. The inventor examined the electrode that had been produced in this way and found that there was a void appearing between the coil and the electrode rod. Here, it was the coil that was mainly melted, and the electrode rod remained as it had been without being melted. As can be understood, a void reduces the heat capacity of the electrode end. This leads to overheating of the electrode end in the actual use, meaning that blackening caused by the deposition of tungsten cannot be prevented.

In accordance with these findings, the present invention addresses the stated problems. The object of the present invention is to provide a high pressure discharge lamp that can prevent blackening, a high pressure discharge lamp electrode whose end does not need to be machined after melting, a method of producing the high pressure discharge lamp electrode, and an illumination device and an image display apparatus respectively using the high pressure discharge lamps.

The object of the present invention can be achieved by a high pressure discharge lamp made up of: a discharge tube having a discharge chamber that contains a light-emitting substance and is hermetically sealed; and a pair of electrodes, each of which has first and second ends and is set in the discharge chamber, the first end of each electrode being secured to the discharge tube and the second ends of the electrodes facing each other at a predetermined distance in the discharge chamber, wherein discharge takes place between the second ends of the electrodes, each electrode made up of an electrode rod with a tip and a covering material, the electrode rod and the covering material being made mainly of tungsten and the tip positionally corresponding to the second end, wherein the covering material covers an outer surface of the electrode rod near the tip, the tip being left uncovered, and the tip of the electrode rod and an adjacent portion of the covering material are fused together by heat generated during an initial discharge, and wherein an inequality $1/50*R3 \leqq \Delta L \leqq 1/5*R3$ is satisfied before the initial discharge takes place, where $\Delta L$ is a length of the tip measured along a direction of a length of the electrode rod and R3 is an outer diameter of the covering material adjacent to the tip.

For this high pressure discharge lamp, the end of the electrode is melted by heat when an initial discharge takes place between the electrodes, so that the electrode rod and the coil are integrally joined to each other at the end of the electrode. It should be noted here that an arc length between the electrodes may vary in a case where the electrodes are set in the discharge tube first and then the electrode ends are melted by heat. However, it became apparent from the analysis by the inventor that the problem associated with the changes in the arc length would be solved when the following Inequality (1) is satisfied.

$$1/50*R3 \leqq \Delta L \leqq 1/5*R3 \quad (1)$$

In Inequality (1), R3 indicates an outer diameter (mm) of the discharge side end of the covering material while $\Delta L$ indicates a length (mm) of the discharge side end of the electrode that is left uncovered with the covering material such as a coil.

In accordance with this finding, the inventor came up with an invention of a high pressure discharge lamp electrode that can solve the stated problems of the prior art. With the construction that satisfies Inequality (1), the arc length will not vary after the end of the electrode has been melted for forming the integral joint. Specifically, this construction can avoid a case where the shape of the electrode end becomes unstable after the melting by heat, i.e. a case where the arc length is increased since it is the electrode rod that mainly melts. Also, this construction can avoid a case where a void appears between the covering material and the electrode rod, i.e. a case where the arc length is reduced since it is the coil that mainly melts and the molten coil bulges due to the void.

The stated problems of the prior art can be solved by a high pressure discharge lamp electrode made up of: an electrode rod which has a tip and is made of a refractory metal; and a coil which is made of a refractory metal wire and covers an outer surface of the electrode rod near the tip, a portion of the coil adjacent to the tip being melted so as to be fused in tight contact with the tip which does not substantially melt and remains in an initial shape.

To be more specific, the electrode end does not need to be machined through such as polishing or grinding after the integral joint. Moreover, blackening caused by overheating of the electrode end can be prevented from occurring to the discharge tube.

BRIEF DESCRIPTION OF THE DRAWINGS

These and other objects, advantages and features of the invention will become apparent from the following description thereof taken in conjunction with the accompanying drawings which illustrate a specific embodiment of the invention. In the drawings:

FIG. 7 and FIG. 8 respectively show relations between $\Delta L$ indicating the length of a tip that is left uncovered and $\Delta A$ indicating a difference with respect to the initial arc length, and also show assessments of the resulting arc lengths;

FIG. 12 shows the results of an experiment conducted to check the level of blackening in relation to the total of impurity contents (ppm) in a third embodiment;

FIG. 13 shows the results of an experiment conducted to check the level of blackening in relation to the Fe content (ppm) in the third embodiment;

FIG. 14 shows the results of an experiment conducted to check the level of blackening in relation to the K content (ppm) in the third embodiment;

DESCRIPTION OF PREFERRED EMBODIMENTS

The following is a description of embodiments of the present invention, with reference to the drawings.

First Embodiment

Figure 1:
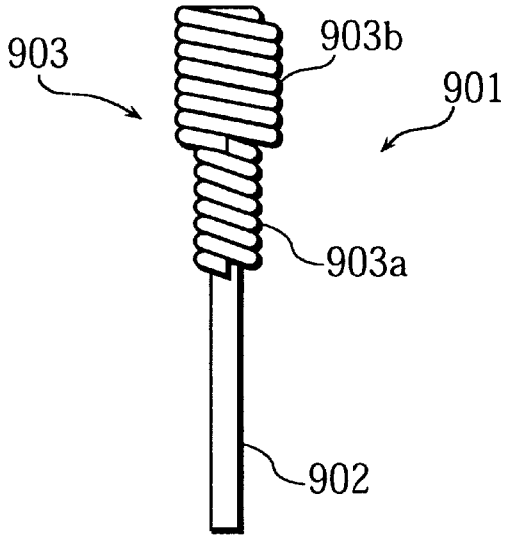
FIG. 1 shows an example of an electrode used in a conventional high pressure mercury lamp.
Figure 2:
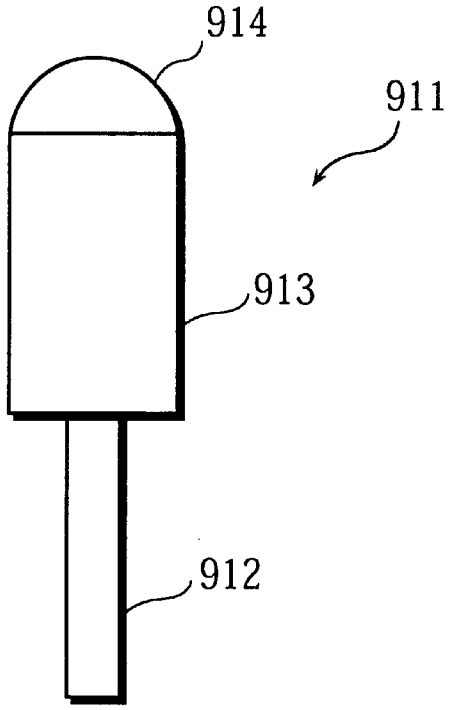
FIG. 2 shows the construction of an electrode disclosed in U.S. Pat. No. 5,537,167.
Figure 3:
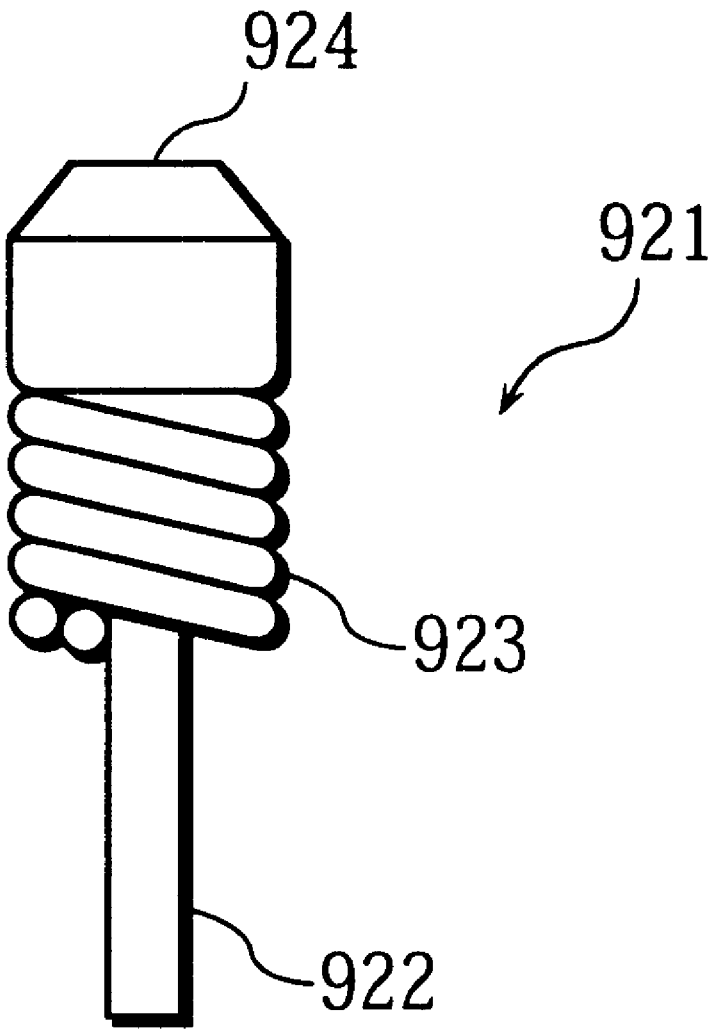
FIG. 3 shows the construction of an electrode disclosed in Japanese Laid-Open Patent Application No. 10-92377.
Figure 4:
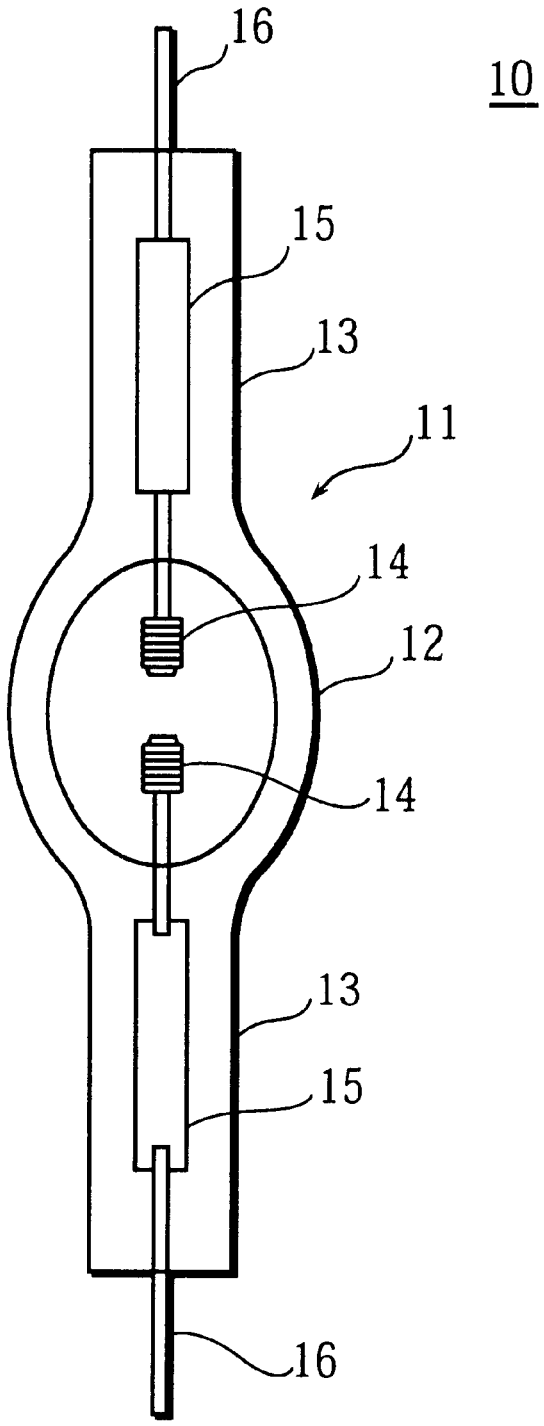
FIG. 4 is a front view of a high pressure mercury lamp 10 of a first embodiment of the present invention.

FIG. 4 is a front view showing a construction example of a high pressure mercury lamp 10 that is taken as an example of the high pressure discharge lamp related to the present invention. As shown in this figure, the high pressure mercury lamp 10 is provided with a discharge tube 11 that is made of quartz glass with its. middle part in the direction of the length being spheroid. The discharge tube 11 includes a light-emitting part 12 and a pair of sealing parts 13. A sealing part 13 is positioned at both ends of the light-emitting part 12. The maximum internal diameter of the central part of the light-emitting part 12 is 7.0 mm, the capacity of the light-emitting part 12 is 0.24 $cm^3$, and the wall thickness is 2.5 mm. The light-emitting part 12 includes a pair of electrodes 14 facing each other, with a length between the discharge side tips of these electrodes 14 (this length is referred to as the "arc length" hereinafter) being 1.55 mm. The light-emitting part 12 is filled with mercury of 36 mg (about 0.16 $mg/mm^3$) as a light-emitting metal, bromine (Br) of $9.0\times10^5$ $\mu mol/mm^3$ as a halogen substance, and argon gas as a starting-up gas at 100 mbar of pressure. The other side-end of each electrode 14 is connected to an outer lead wire 16 by a metal foil conductor 15, such as molybdenum.

Figure 5:
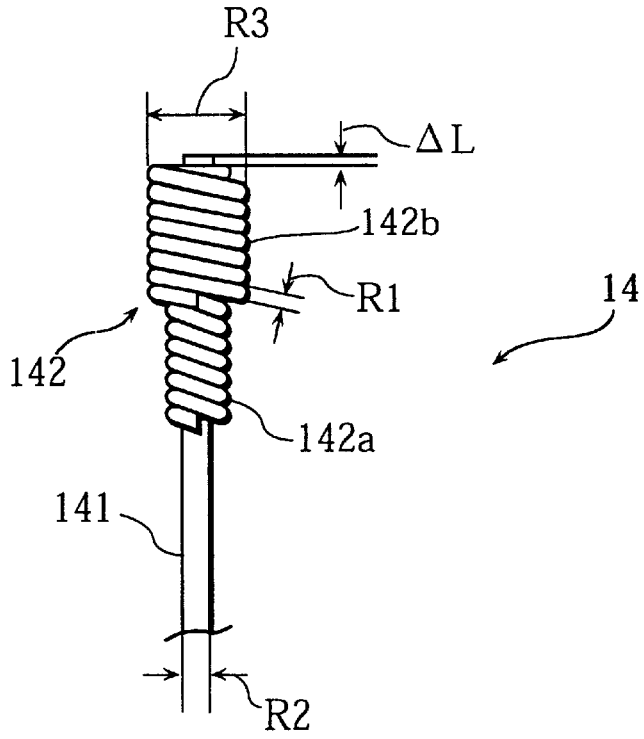
FIG. 5 is an enlarged front view of an electrode 14 used in the high pressure mercury lamp 10 of the first embodiment.

As shown in FIG. 5, each electrode 14 has an electrode rod 141 and an electrode coil 142 that is provided at the end of the electrode rod 141. The outer diameter of the electrode rod 141 is 0.4 mm, and this diameter may be indicated as "R2" hereinafter. The thickness of the coil 142 is 0.25 mm, and this thickness may be indicated as "R1" hereinafter. The coil 142 has a closely-wound double-layered structure. Specifically, a first layer 142*a* has 15 turns while a second layer 142*b* consisting of 8 turns is wound around the first layer 142*a*. In the present embodiment, the electrode coil 142 is provided, according to the typical method, around the end of the electrode rod 141 leaving 0.10 mm at the tip of the rod 141 uncovered. Hereinafter, this length of the tip that is left uncovered with the covering material may be indicated as ΔL. With this state, the coil 142 is fixed to the electrode rod 141 by resistance welding.

Figure 6:
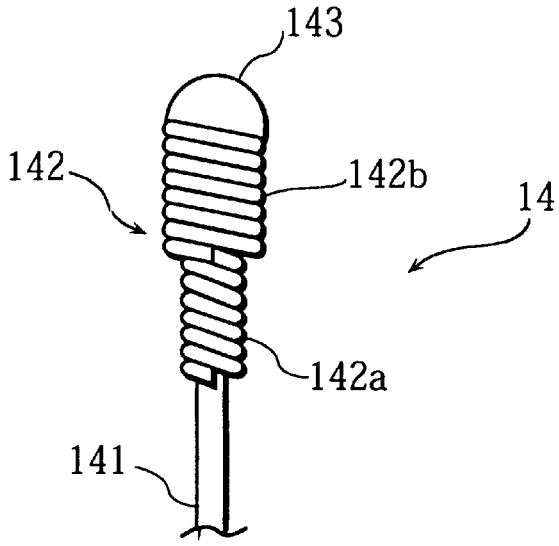
FIG. 6 is a shape example of the electrode 14 after the end of the electrode 14 is melted.

By the initial discharge to be taken place when the high pressure mercury lamp 10 is lit up for the first time, both discharge side ends of the electrode rod 141 and the coil 142 are melted by heat, thereby forming an integrated portion 143 at the discharge side end of the electrode 14. By the provision of the integrated portion 143, the heat capacity of the discharge side end of the electrode 14 is increased to an appropriate value and hence suppresses overheating of the electrode end during a discharge to prevent an excessive melting of the electrode end. Thereafter, the electrode 14 functions as having the construction that is shown in FIG. 6.

When the end of the electrode 14 is melted by heat during the initial discharge to form the integrated portion 143 as described above, the arc length may vary depending on the particular deformation of the end of the electrode 14. The changes in the arc length lead to a problem. Specifically, if the arc length is shortened after the coil around the end of the electrode has been partially melted, a voltage between the electrodes 14 drops, meaning that a larger amount of current has to be fed. This results in the promotion of blackening. However, the inventor found after an analysis that the changes in the arc length between the electrodes 14 could be suppressed by leaving a tiny tip of the discharge side end of the electrode rod 141 uncovered with the coil 142 as shown in FIG. 5.

The analysis was performed on a relation between a change in the arc length and a length of the uncovered tip of the electrode rod 141 (indicated as ΔL in FIG. 5), and results of the analysis are explained as follows. FIG. 7 and FIG. 8 respectively show relations between the length ΔL and ΔA that indicates a difference with respect to the initial arc length, and also show assessments of the resulting arc lengths.

In the tables shown in FIGS. 7 and 8, the first horizontal row shows values (mm) of the length ΔL, while the second horizontal row shows values obtained by dividing the corresponding length ΔL by the outer diameter of the discharge side end of the coil 142. This outer diameter of the coil 142 is indicated as "R3" in FIG. 5 and specifically refers to an outer diameter of the first turn of the second (outermost) layer 142*b*. For the electrode 14 used in the case of FIG. 7, the outer diameter (R2) of the electrode rod 141 was 0.4 mm and the thickness of the coil 142 (R1) was 0.2 mm. Thus, the outer diameter R3 of the coil 142 was obtained as 0.4+0.2*4=1.2(mm). The third horizontal row of the tables shown in FIGS. 7 and 8 shows ΔA that indicates a difference of the arc length with respect to the initial arc length of 1.5 mm.The fourth horizontal row shows the assessments of the resulting arc lengths. More specifically, when ΔA is within ±10% with respect to the initial arc length of 1.5 mm, the assessment is represented by ○. The assessment is represented by X when ΔA is beyond ±10% with respect to the initial arc length. The electrode 14 used in the case of FIG. 8 was the same as that was used in the case of FIG. 7, except that the thickness of the coil 142 (R1) used in the case of FIG. 8 was 0.25 mm.

As understood from the tables shown in FIGS. 7 and 8, the value of ΔA was within tolerance when the value of ΔL/R3 shown in the second horizontal row lied from 1/50 to 1/5. The inventor found that only when the length ΔL satisfied the following Inequality (1), the changes in the arc length were within tolerance after the end of the electrode was melted by heat for the integral joint during the initial discharge.

$$1/50*R3 \leqq \Delta L \leqq 1/5*R3 \quad (1)$$

The following are the reasons why the changes in the arc length are suppressed when Inequality (1) is satisfied. First suppose that the length ΔL is less than 1/50 of the outer diameter of the coil 142 (R3). Note that this state includes a case where ΔL<0, that is, the-discharge side end of the coil 142 is extended longer than the discharge side tip of the electrode rod 141. In this-case, the coil 142 melts first before the electrode rod 141. The coil 142 seems to melt in such a manner that the coil 142 around the discharge side end of the electrode rod 141 melts and moves from the shank side to the tip side of the electrode rod 141 to cover the whole tip of the rod 141. Due to this melting manner of the coil 142, a void appears between the electrode rod 141 and the coil 142 and hence the molten coil portion bulges outward from the electrode rod 141 thereby shortening the arc length. Meanwhile, when the length ΔL exceeds 1/5of the outer diameter of the coil 142 (R3), the end of the electrode rod 141 melts and the coil 142 hardly melts. As a consequence of the melting of the end of the electrode rod 141, it seems that the arc length is increased since the length of the electrode rod 141 is shortened.

Accordingly, the satisfaction of Inequality (1) suppresses the changes in the arc length. Moreover, the suppression of the changes in the arc length raises expectations that the problems of the prior art can be solved. As described earlier, the first problem in the prior art is blackening that occurs due to the appearance of the void between the electrode rod 141 and the coil 142. The second problem in the prior art is the instability of the molten shape of the electrode end that is ascribable to that the electrode rod 141 mainly melts with the coil 142 not melting.

Actually, the inventor examined the integrally-jointed end of the electrode and found that in most cases it was the coil 142 that mainly melted and the shape of the end of the electrode rod 141 was hardly deformed even when the amount of change in the arc length was within tolerance. Yet, by defining the length ΔL, even when the coil 142 mainly melts, the coil 142 can be controlled to appropriately melt intimately integral with the electrode rod 141. Thus, a void can be prevented from appearing between the electrode rod 141 and the coil 142.

From the above-mentioned findings, the high pressure mercury lamp 10 of the present embodiment can prevent the heat capacity of the electrode end from decreasing due to the void appearing between the electrode rod 141 and the coil 142, and also prevent blackening that is ascribable to the decreased heat capacity. Additionally, the integrally-jointed end of the electrode 14 does not need to be machined.

Next, an explanation is given regarding a relation between the outer diameter of the electrode rode 141 (R2) and the thickness of the coil 142 (R1) for the electrode 14 of the present embodiment. It is preferable that both the thickness R1 and the diameter R2 satisfy the following Inequality (2).

$$1/4 \leqq R1/R2 \leqq 3/4 \quad (2)$$

The following are the reasons why the thickness R1 and the diameter R2 should satisfy Inequality (2).

If the current relation between the thickness R1 and the diameter R2 is expressed as 1/4>R1/R2, there would be two cases where the thickness R1 is too thin for the diameter R2 and where the diameter R2 is too large for the thickness R1. In the former case, the heat capacity of the discharge side end of the electrode 14 cannot be adequately secured and so facilitates overheating of the end of the electrode 14 during the lamp operation. The overheating results in blackening. In the latter case, the heat conductivity of the electrode rod 141 becomes so large that the temperature of the discharge side end of the electrode 14 drops more than necessary. Due to the decreased temperature of the end of the electrode 14, the discharge cannot be continued since thermoelectrons are not emitted.

Meanwhile, if the current relation between the thickness R1 and the diameter R2 is expressed as 3/4<R1/R2, there would be two cases where the thickness R1 is too thick for the diameter R2 and where the diameter R2 is too small for the thickness R1. In the former case, it is impractical to set the coil 142 with such a thickness around the electrode rod 141. In the latter case, the heat conductivity of the electrode rod 141 becomes so small that the temperature of the electrode end excessively rises during lamp operation. This overheating results in blackening. For these reasons, both the thickness R1 and the diameter R2 should satisfy Inequality (2).

Generally speaking, for manufacturing high pressure mercury lamps with power ratings from 100 W to 200 W, the optimum thickness R1 of the coil 142 lies between 0.15 mm to 0.30 mm, and the optimum outer diameter R2 of the electrode rod 141 lies between 0.3 mm to 0.5 mm. In accordance with these respective ranges, material to be used for the electrode rod 141 and the coil 142 should be selected so that Inequality (2) is satisfied.

A major constituent of material used for making the electrode rod 141 and the coil 142 is tungsten. However, it is hard to completely remove the contained impurities from tungsten. In the present embodiment, tungsten contains impurities, such as potassium, iron, aluminum, calcium, chromium, molybdenum, nickel, and silicon. In the present embodiment, the total content of these impurities in tungsten is 20 ppm, that the content of potassium is 5 ppm, and that the content of iron is 5 ppm. In general, however, it can be said that the less the content of impurities in the electrode, the better. The detailed description will be given later for the impurity contents in the electrodes of the high pressure discharge lamp of the present invention.

As described up to this point, the high pressure discharge lamp of the present embodiment can prevent blackening and the integrally-jointed end of the electrode does not need to be machined.

Second Embodiment

In the first embodiment, the electrode around which the coil has been provided beforehand is extended into the discharge tube, and then the end of the electrode is integrally melted during the initial discharge taken place when the high pressure mercury lamp is lit up for the first time. However, as explained in detail in the first embodiment, the changes in the arc length can be suppressed by defining the length ΔL of the end of the electrode rod that is left uncovered with the coil. This is to say, by defining the length ΔL in the same way as described, the stated problems in the prior art can be also solved when only high pressure discharge lamp electrodes are manufactured.

Accordingly, a description is given in the present embodiment for a case where electrodes are independently manufactured. Therefore, contrary to the first embodiment, an electrode is fully formed before being extended into a discharge tube in the present embodiment.

Figure 9:
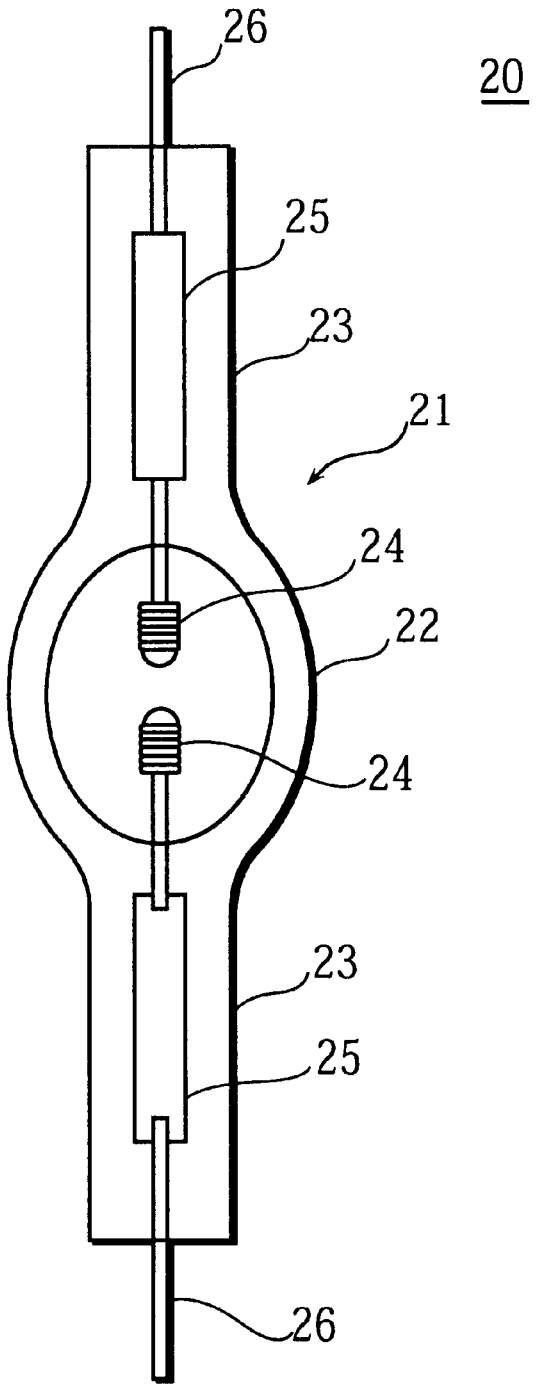
FIG. 9 is a front view of a high pressure mercury lamp 20 of a second embodiment of the present invention.

FIG. 9 is a front view showing the construction of a high pressure mercury lamp 20 of the present embodiment. The high pressure mercury lamp 20 has the same construction as the high pressure mercury lamp 10 shown in FIG. 4 of the first embodiment except that the shape of each electrode 24 is different from the shape of each electrode 14. As such, the explanation for parts other than the electrode 24 is omitted in the present embodiment.

Figure 10:
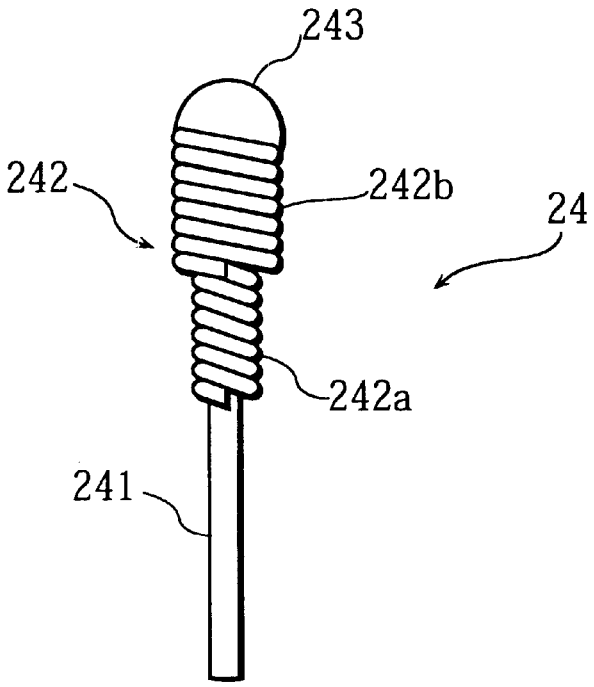
FIG. 10 is an enlarged front view of an electrode 24 used in the high pressure mercury lamp 20 of the second embodiment.

FIG. 10 shows the construction of the electrode 24 of the present embodiment. As seen from this figure, the electrode 24 is almost in the same shape as the electrode 14 having the integrally-jointed end as shown in FIG. 6. The electrode 24 is formed by setting a coil 242 whose thickness is 0.25 mm around an electrode rod 241 whose diameter is 0.4 mm.

Both discharge side ends of the electrode rod 241 and the coil 242 are melted by heat, thereby forming an integrated portion 243 at the discharge side end of the electrode 24. As is the case with the first embodiment, the coil 242 has a closely-wound double-layered structure. Specifically, a first layer 242*a* has 15 turns while a second layer 242b consisting of 8 turns is wound around the first layer 242*a*. The electrode coil 242 is provided, according to the typical method, around the end of the electrode rod 241 leaving an appropriate length uncovered at the tip of the rod 241 so that Inequality (1) is satisfied. With this state, the coil 242 is fixed to the electrode rod 241 by resistance welding. Here, in the present embodiment, before setting this electrode 24 into a discharge tube 21, both discharge side ends of the electrode rod 241 and the coil 242 are melted to form the integrated portion 243. To be more specific, after the resistance welding, a portion of the electrode rod 241 measured about 0.73 mm from the discharge side tip of the rod 241 and a portion of the coil 242 measured about 0.63 mm (that is, 2.5 turns of coil) from the discharge side end of the coil 242 are integrally melted by heat.

Figure 11:
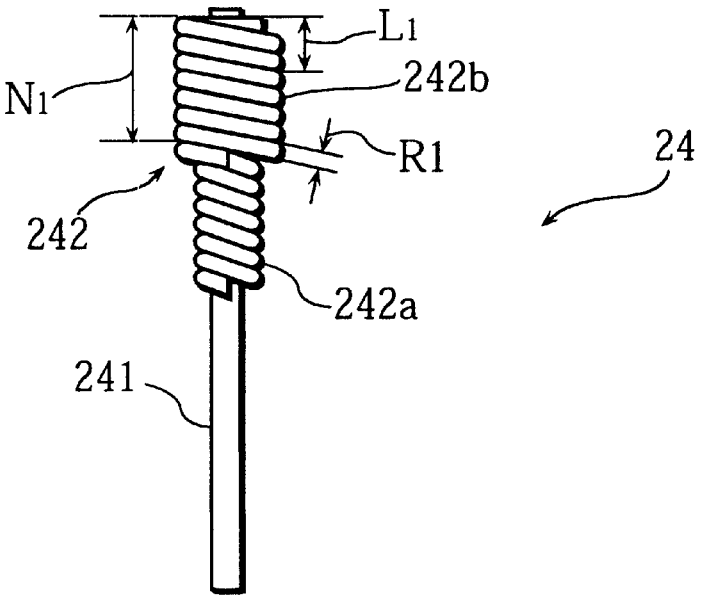
FIG. 11 is a drawing to help explain a process for melting the end of the electrode 24 used in the high pressure mercury lamp 20 of the second embodiment.

The relations between the length ΔL of the electrode rod 241 and the outer diameter of the coil 242 and between the diameter of the electrode rod 241 and the thickness of the coil 242 can be considered in the same way as in the first embodiment. In the present embodiment, however, the discharge side end of the electrode 24 is melted before being set in the discharge tube 21. As such, an explanation is given for a length by which the end of the electrode is melted. FIG. 11 is a drawing to help explain a preferable range of the length. Suppose that the length of the coil 242 to be melted is L1(mm) measured from the discharge side end, that the thickness of the coil 242 is R1(mm), and that the length of the second layer 242*b* measured along the rod 241 is N1(mm). In this case, it is preferable for these values to satisfy the following Inequality (3).

$$R1 \leqq L1 \leqq 0.5*N1 \quad (3)$$

The following are the reasons why Inequality (3) should be satisfied.

If the current relation between the length L1 and the thickness R1 is expressed as R1>L1, that is, if the length L1 is shorter than the thickness R1, it would be difficult to melt only the part measured L1 from the end of the coil 242 in consideration of manufacturability. Additionally, the heat capacity of the discharge side end of the electrode 24 cannot be adequately secured and so facilitates overheating of the end of the electrode 24. Thus, there may be a case where blackening cannot be prevented.

Meanwhile, if the current relation between the length L1 and the length Ni of the second layer 242*b* is expressed as L1>0.5*N1, that is, if more than half the length N1 of the second layer 242*b* is to be melted, the heat capacity of the electrode 24 becomes so large that the temperature of the discharge side end of the electrode 24 drops more than necessary. Due to this decreased temperature of the end of the electrode 24, the discharge cannot be continued since thermoelectrons are not emitted.

It should be noted here that the melting of the electrode end can be achieved using a laser or plasma. When electrical discharge machining is performed using argon plasma, for example, the length L1 can be controlled by changing a discharge interval or the number of discharges of argon plasma. Specifically, the length L1 can be lengthened by increasing the number of discharges or shortening the discharge interval.

Accordingly, the integrally-jointed end of the electrode 24 to be used in the high pressure discharge lamp does not need to be machined. Also, when a high pressure discharge lamp including such an electrode is manufactured, blackening caused by a void appearing between the electrode rod and the coil can be prevented.

Third Embodiment

In the third embodiment of the present invention, an explanation is given for results obtained by studying the content of impurities contained in an electrode whose major constituent is tungsten.

In general, tungsten preferably contains less impurities, such as potassium, iron, aluminum, calcium, chromium, molybdenum, nickel, and silicon. Yet, it is difficult to completely remove these impurities from tungsten using an existing purification method. To address this problem, the inventor studied the electrode 24 that is to be used in a high pressure discharge lamp as described in the second embodiment so as to find out the level of impurity content in the electrode 24 at which blackening can be more effectively prevented.

The following is a brief explanation how blackening occurs in relation to the impurity content in the electrode. The tungsten forming the electrode 24 is easily alloyed with potassium, iron, aluminum, calcium, chromium, molybdenum, nickel, and silicon that are contained as impurities in the electrode 24. When tungsten is alloyed with these impurities, a melting point of this alloy, i.e. a melting point of the electrode 24, is lowered and fly-offs from the electrode 24 adhere to the inner wall of the discharge tube 21, causing blackening.

FIG. 12 is a table showing the levels of blackening in relation to the total of impurity contents. These results were obtained through an experiment. To be more specific, high pressure mercury lamps were made using the method described in the second embodiment, with the impurity content in the electrode 24 being changed for each lamp. Then, these high pressure mercury lamps thus prepared were lit up and, after 3 hours, each level of blackening occurring to the lamps was visually assessed. In the table, ◎indicates that blackening did not occur, ○indicates that blackening hardly occurred, ▼ indicates that blackening slightly occurred, and X indicates that a high level of blackening occurred. Note that the impurity content was measured according to the atomic absorption method. The signs representing the levels of blackening will be the same in the following FIGS. 13 and 14, and the method of measuring the impurity content will be also the same.

As shown in FIG. 12, there was practically no problem when the total impurity content was 40 ppm or less. It was more preferable especially when the impurity content was 25 ppm or less.

Next, the levels of blackening were checked in relation to contents of iron. This experiment was conducted in view of the fact that iron is particularly likely to be alloyed with tungsten. For the experiment, high pressure mercury lamps were made, with iron content in the electrode 24 being changed for each lamp. The results of this experiment are shown in the table of FIG. 13.

As shown in FIG. 13, there was practically no problem when the iron content was 20 ppm or less. It was more preferable especially when the iron content was 10 ppm or less.

Similarly, the levels of blackening were checked in relation to contents of potassium. This experiment was conducted in view of the fact that potassium is known as interfering with a halogen cycle. For this experiment, high pressure mercury lamps were made again, with potassium content in the electrode 24 being changed for each lamp. The results of this experiment are shown in the table of FIG. 14.

As shown in FIG. 14, there was practically no problem when the potassium content was 12 ppm or less. It was more preferable especially when the potassium content was 10 ppm or less.

Accordingly, the experiments showed that it was preferred to define the total impurity content at 40 ppm or less, the iron content at 20 ppm or less, and the potassium content at 12 ppm or less. It should be noted here again that the less the content of impurities in the electrode, the better.

Fourth Embodiment

Figure 15:
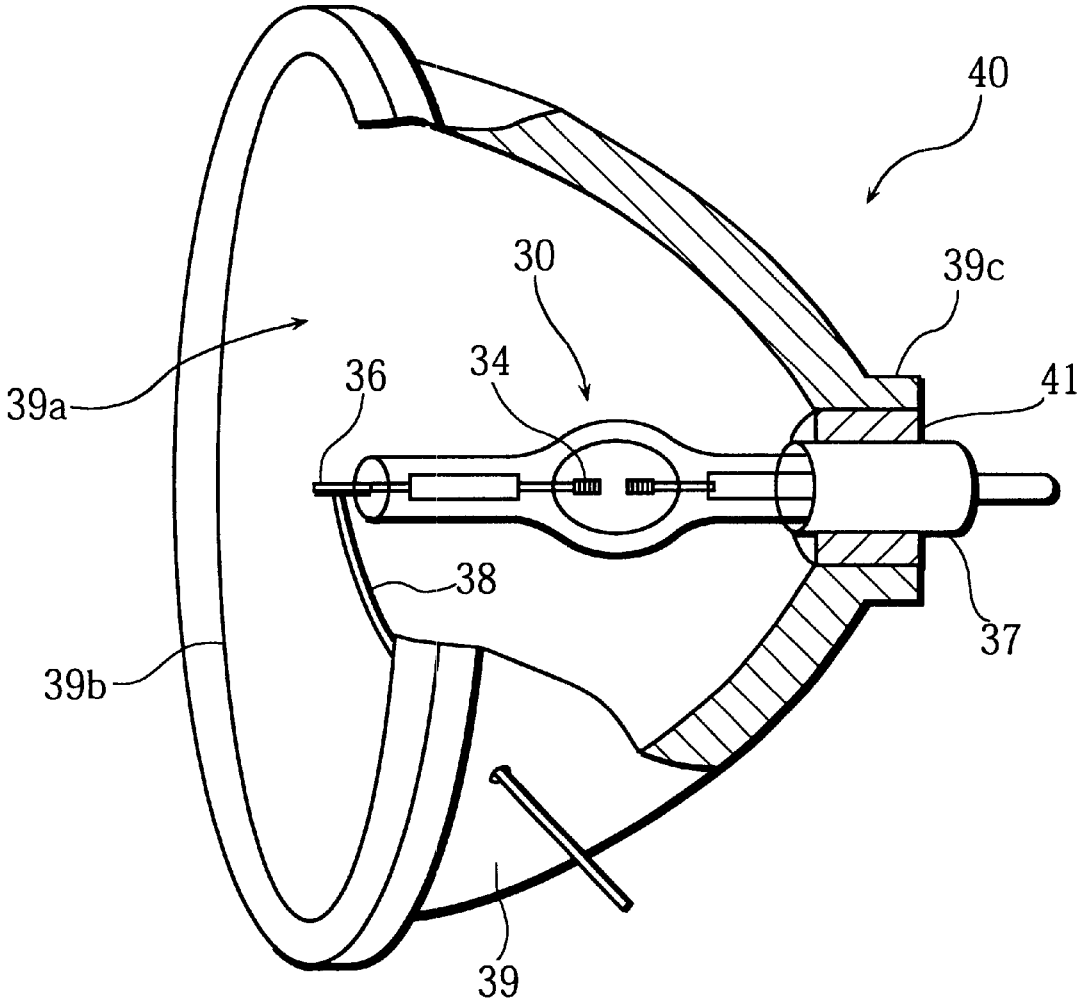
FIG. 15 shows a construction example of an illumination device using the high pressure mercury lamp of the present invention.

In the fourth embodiment, an illumination device and an image display device respectively using the high pressure discharge lamps of the present invention are described. FIG. 15 is a partially cutaway perspective view that shows a construction example of an illumination device 40 using the high pressure discharge lamp. As shown in this figure, one outer lead wire (not shown) of a high pressure mercury lamp 30 is connected to a base 37 while the other outer lead wire 36 is connected to a power supplying wire 38. As the high pressure mercury lamp 30 of the present embodiment, the high pressure mercury lamp 10 described in the first embodiment or the high pressure mercury lamp 20 using the electrode 24 described in the second embodiment can be used.

As shown in FIG. 15, the illumination device 40 is formed by integrally setting the high pressure mercury lamp 30 inside a reflecting mirror 39 so that the arc axis of the high pressure mercury lamp 30 lies in the optical axis of the reflecting mirror 39. The reflecting mirror 39 of the present embodiment is made of ceramic and formed in the shape of an infundibular. The reflecting mirror 39 has a reflecting surface 39*a* which is coated with titanium oxide-silicon oxide. The reflecting mirror 39 also has an opening 39*b*,i.e., a light projecting part, which is about 70 mm in diameter. The reflecting mirror 39 has a supporting tube 39*c* facing the opening 39*b*.The base 37 fitted at one end of the high pressure mercury lamp 30 is inserted into and fixed to the supporting tube 39*c* via an insulating cement 41. The power supplying wire 38 connected to the other lead wire 36 passes through a hole drilled through the wall of the reflecting mirror 39 and is guided to outside.

Figure 16:
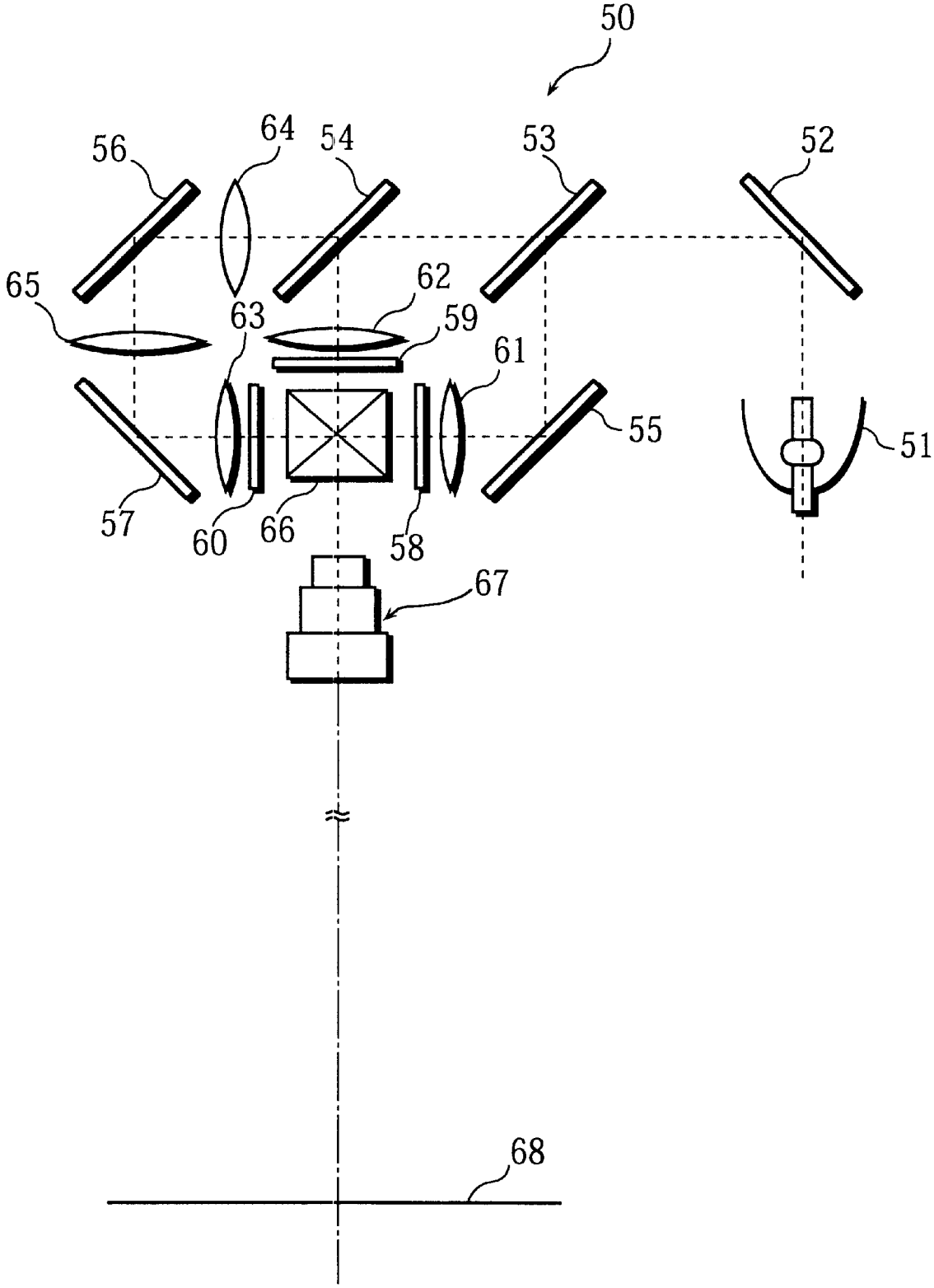
FIG. 16 shows a construction example of an image display apparatus using the high pressure mercury lamp of the present invention.

Next, an image display apparatus using a high pressure discharge lamp of the present invention is described. FIG. 16 is a schematic view helping explain the construction of an image display apparatus 50 that includes the illumination device 40 having the high pressure mercury lamp 30.

As shown in FIG. 16, the image display apparatus 50 is composed of a light source unit 51 including the illumination device 40, a mirror 52, dichroic mirrors 53 and 54, mirrors 55 to 57, liquid crystal light valves 58 to 60, field lenses 61 to 63, relay lenses 64 and 65, a dichroic prism 66, and a projection lens 67. The dichroic mirrors 53 and 54 separate white light received from the light source unit 51 into the primary colors of light, that is, blue, green, and red lights. The mirrors 55 to 57 respectively reflect the separated lights. The liquid crystal light valves 58 to 60 are respectively used for forming single-color light images for the primary colors. The dichroic prism 66 collects the lights that have respectively passed through the liquid crystal light valves 58 to 60. An image formed in the image display apparatus 50 is projected onto a screen 68. Except that the high pressure discharge lamp of the present invention is used in the light source unit 51, the image display apparatus 50 as shown in FIG. 16 has the same construction as a conventional apparatus that is well known as a "three-panel type" image display apparatus. Therefore, a detailed explanation about the construction of the image display apparatus 50 is omitted in the present embodiment. Note that some optical elements, such as a UV filter, are not-shown in FIG. 16 for convenience of explanation.

The following is a description of results obtained through a life test that was conducted on the image display apparatus 50 of the present invention having the stated construction and on a conventional image display apparatus. Note that this conventional image display apparatus had the same construction as the image display apparatus 50 except for the length ΔL of the electrode rod of the lamp used in the light source unit 51. Specifically, the length ΔL of the image display apparatus 50 satisfied Inequality (1) while the length ΔL of the conventional image display apparatus did not. Now, an AC power was connected between the base of the lamp and the power supplying wire for each of the apparatus 50 and the conventional apparatus. Then, the respective high pressure mercury lamps were lit up under about 75 V of lamp voltage, about 2.3 A of lamp current, and 175 W of lamp power. The results of this life test are shown in FIG. 17.

Figure 17:
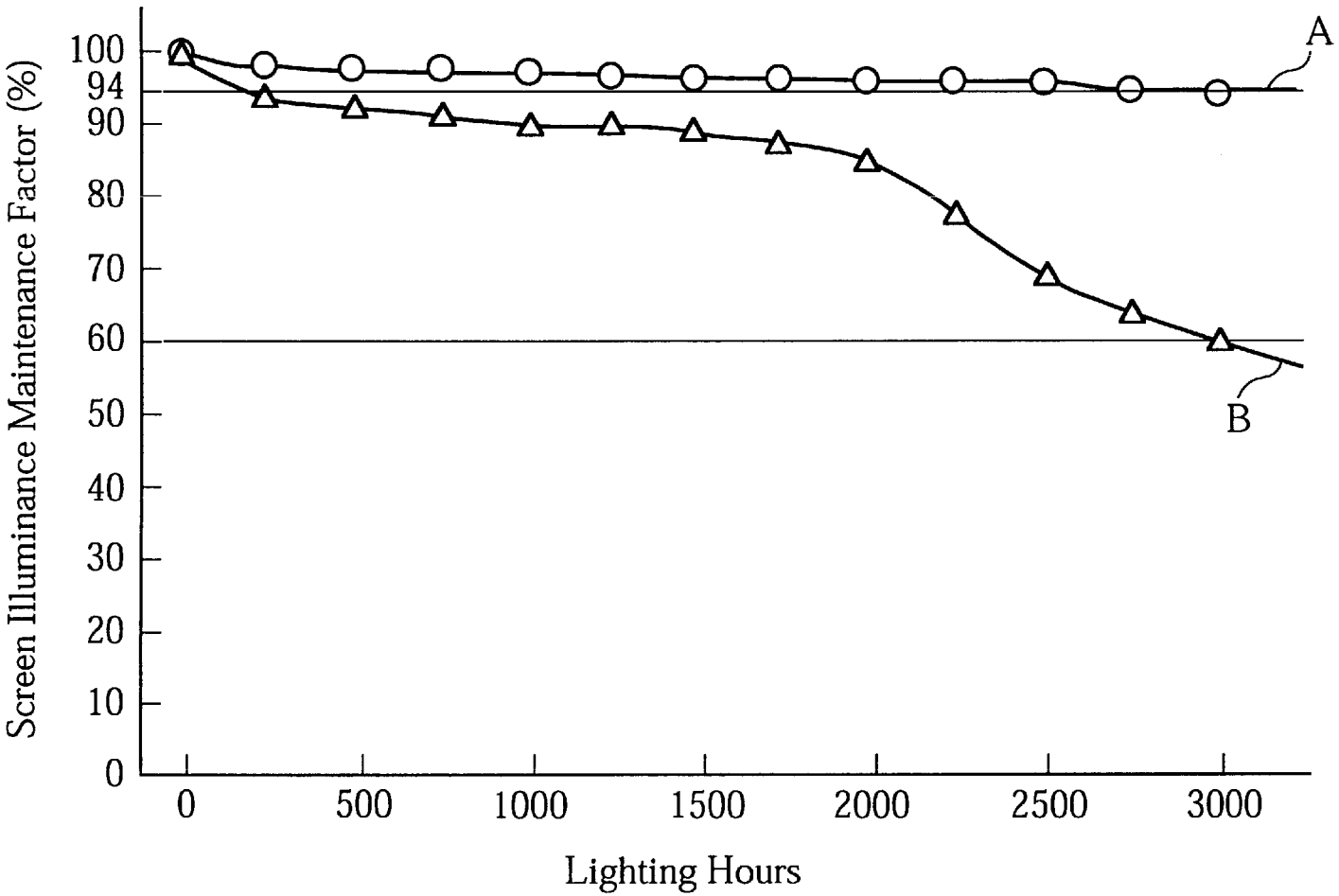
FIG. 17 shows a relation between the period of time during which the lamp has been lit up and the screen illuminance maintenance factor in a fourth embodiment.

As shown in FIG. 17, the screen illuminance maintenance factor of the apparatus 50 (drawn in the line A) was 94 % after 3,000 hours had elapsed since the lamp was lit up. Meanwhile, the screen illuminance maintenance factor of the conventional apparatus (drawn in the line B) was only about 60 % after 3,000 hours, practically interfering with the ongoing lamp operation.

These results are ascribable to that blackening did not occur to the inner surface of the discharge tube of the apparatus 50 while the high level of blackening occurred to the conventional apparatus. As described in detail in the preceding embodiments, blackening can be prevented from occurring to the inner surface of the discharge tube when the high pressure discharge lamp of the present invention is used. Additionally, the life test of the fourth embodiment proved that the present invention can provide a high pressure mercury lamp, an illumination device, and an image display apparatus that have long lives and improved illuminance maintenance factors.

Modification

The present invention has been described in accordance with the preceding embodiments. It should be obvious that the present invention is not limited to these embodiments, so that the following modification can be made.

In the preceding embodiments, the explanations have been given in a case where a high-pressure mercury lamp having 175 W of lamp power is used. However, the high-pressure discharge lamp of the present invention is not limited to this. For example, the same effect can be achieved using a high pressure mercury lamp having another lamp power, such as 200 W.

A high pressure discharge lamp of the present invention is not limited to a high pressure mercury lamp. In the preceding embodiments, mercury is used as a light-emitting metal, argon gas as a starting-up gas, and bromine for facilitating a halogen cycle. However, other elements may be used instead. More specifically, mercury may be replaced with one of various other metal halides that are used in metal halide lamps in general, and argon gas may be replaced with one of various other rare gases, such as xenon gas or neon gas. Bromine may be replaced with a halogen substance, such as chlorine or iodine.

Although the present invention has been fully described by way of examples with reference to the accompanying drawings, it is to be noted that various changes and modifications will be apparent to those skilled in the art.

Therefore, unless such changes and modifications depart from the scope of the present invention, they should be construed as being included therein.

What is claimed is:

1. A high pressure discharge lamp comprising:

a discharge tube having a discharge chamber that contains a light-emitting substance and is hermetically sealed; and a pair of electrodes, each of-which has first and second ends and is set in the discharge chamber, the first end of each electrode being secured to the discharge tube and the second ends of the electrodes facing each other at a predetermined distance in the discharge chamber, wherein discharge takes place between the second ends of the electrodes, each electrode comprising an electrode rod with a tip and a covering material, the electrode rod and the covering material being made mainly of tungsten and the tip positionally corresponding to the second end, wherein the covering material covers an outer surface of the electrode rod near the tip, the tip being left uncovered, and the tip of the electrode rod and an adjacent portion of the covering material are fused together by heat generated during an initial discharge, and wherein an inequality $1/50*R3 \leqq \Delta L \leqq 1/5*R3$ is satisfied before the initial discharge takes place, where $\Delta L$ is a length of the tip measured along a direction of a length of the electrode rod and R3 is an outer diameter of the covering material adjacent to the tip.

2. The high pressure discharge lamp of claim 1, wherein the covering material is an electrode coil which is made of a tungsten wire.

3. The high pressure discharge lamp of claim 2, wherein an inequality $1/4 \leqq R1/R2 \leqq 3/4$ is satisfied, where R1 is a thickness of the tungsten wire and R2 is an outer diameter of the electrode rod.

4. The high pressure discharge lamp of claim 3, wherein the thickness of the tungsten wire is 0.2 mm, the outer diameter of the electrode rod is 0.4 mm, and the length $\Delta L$ satisfies an inequality $0.024 \leqq \Delta L \leqq 0.24$.

5. The high pressure discharge lamp of claim.3, wherein the thickness of the tungsten wire is 0.25 mm, the outer diameter of the electrode rod is 0.4 mm, and the length $\Delta L$ satisfies an inequality $0.028 \leqq \Delta L \leqq 0.28$.

6. The high pressure discharge lamp of claim 1, wherein a total content of impurities that are contained in the tungsten used as a major constituent to manufacture the electrode is 40 ppm or less, of which 12 ppm or less is potassium and 20 ppm or less is iron.

7. A high pressure discharge lamp electrode comprising:

an electrode rod which has a tip and is made of a refractory metal; and a coil which is made of a refractory metal wire and covers an outer surface of the electrode rod near the tip, a portion of the coil adjacent to the tip being melted so as to be fused in tight contact with the tip which does not substantially melt and remains in an initial shape.

8. The high pressure discharge lamp electrode of claim 7, wherein the electrode rod and the coil are made mainly of tungsten.

9. The high pressure discharge lamp electrode of claim 8, wherein a total content of impurities that are contained in the tungsten used as a major constituent to manufacture the electrode is 40 ppm or less, of which 12 ppm or less is potassium and 20 ppm or less is iron.

10. The high pressure discharge lamp electrode of claim 7, wherein an inequality $L1 \leqq 0.5*N1$ is satisfied, where L1 is a length of a portion of the coil which melts and N1 is a length of an outermost layer of the coil, both of the lengths L1 and N1 being measured from a top of the coil along a direction of a length of the electrode rod.

11. The high pressure discharge lamp electrode of claim 10, wherein an inequality $R1 \leqq L1$ is satisfied, where R1 is a thickness of the refractory metal wire.

12. The high pressure discharge lamp electrode of claim 7, wherein the tip of the electrode rod is left uncovered by the coil before the melting, a length of the tip measured along the direction of the length being $\Delta L$ that satisfies an inequality $1/50*R3 \leqq \Delta L \leqq 1/5*R3$ where R3 is an outer diameter of the coil adjacent to the tip, and wherein the tip of the electrode rod and the portion of the coil are fused together using one of a laser or plasma.

13. A high pressure discharge lamp comprising:

a discharge tube having a discharge chamber that contains a light-emitting substance and is hermetically sealed; and a pair of electrodes, each of which has first and second ends and is set in the discharge chamber, the first end of each electrode being secured to the discharge tube and the second ends of the electrodes facing each other at a predetermined distance in the discharge chamber, wherein discharge takes place between the second ends of the electrodes, the electrode comprising:

an electrode rod which has a tip and is made of a refractory metal; and a coil which is made of a refractory metal wire and covers an outer surface of the electrode rod near the tip, a portion of the coil adjacent to the tip being melted so as to be fused in tight contact with the tip which does not substantially melt and remains in an initial shape.

14. The high pressure discharge lamp of claim 13, wherein the electrode rod and the coil are made mainly of tungsten.

15. The high pressure discharge lamp of claim 14, wherein a total content of impurities that are contained in the tungsten used as a major constituent to manufacture the electrode is 40 ppm or less, of which 12 ppm or less is potassium and 20 ppm or less is iron.

16. A high pressure discharge lamp comprising:

a discharge tube; and.

a pair of electrodes, each of which has first and second ends and is set in the discharge chamber, the first end of each electrode being secured to the discharge tube and the second ends of the electrodes facing each other at a predetermined distance in the discharge chamber, wherein discharge takes place between the second ends of the electrodes, the electrode comprising an electrode rod and a solid portion which are made mainly of tungsten, the solid portion being formed at a top of the electrode rod and the top positionally corresponding to the second end, wherein a total content of impurities that are contained in the tungsten used for manufacturing the electrode is 40 ppm or less, of which 12 ppm or less is potassium and 20 ppm or less is iron.

17. An illumination device comprising:

a high pressure discharge lamp; and a reflecting mirror which directs a light emitted from the high pressure discharge lamp in a predetermined direction, the high pressure discharge lamp comprising:

a discharge tube having a discharge chamber that contains a light-emitting substance and is hermetically sealed; and a pair of electrodes, each of which has first and second ends and is set in the discharge chamber, the first end of each electrode being secured to the discharge tube and the second ends of the electrodes facing each other at a predetermined distance in the discharge chamber, wherein discharge takes place between the second ends of the electrodes, the electrode comprising:

an electrode rod which has a tip and is made of a refractory metal; and a coil which is made of a refractory metal wire and covers an outer surface of the electrode rod near the tip, a portion of the coil adjacent to the tip being melted so as to be fused in tight contact with the tip which does not substantially melt and remains in an initial shape.

18. The illumination device of claim 17 wherein the high pressure discharge lamp is integrally set inside the reflecting mirror so that an arc axis of the high pressure discharge lamp lies in an optical axis of the reflecting mirror.

19. An image display apparatus comprising:

a high pressure discharge lamp;

a reflecting mirror which directs a light emitted from the high pressure discharge lamp in a predetermined direction;

a light collecting unit for collecting a light reflected off the reflecting mirror;

an image forming unit for forming an image in accordance with the collected light; and a projecting unit for projecting the image onto a projection surface, the high pressure discharge lamp comprising:

a discharge tube having a discharge chamber that contains a light-emitting substance and is hermetically sealed; and a pair of electrodes, each of which has first and second ends and is set in the discharge chamber, the first end of each electrode being secured to the discharge tube and the second ends of the electrodes facing each other at a predetermined distance in the discharge chamber, wherein discharge takes place between the second ends of the electrodes, the electrode comprising:

an electrode rod which has a tip and is made of a refractory metal; and a coil which is made of a refractory metal wire and covets an outer surface of the electrode rod near the tip, a portion of the coil adjacent to the tip being melted so as to be fused in tight contact with the tip which does not substantially melt and remains in an initial shape.

20. A high pressure discharge lamp comprising:

a discharge tube with a discharge chamber; and a pair of electrodes, each of which has first and second ends, the first end of each electrode being secured to the discharge tube and the second ends of the electrodes facing each other at a predetermined distance in the discharge chamber, wherein a discharge takes place between the second ends of the electrodes, each electrode comprises an electrode rod and an encircling unit adjacent the second end with the electrode rod extending a length ΔL from the encircling unit to the second end and satisfying the following condition:

$$1/50*R_3 \leqq \Delta L \leqq 1/5*R_3$$

wherein $R_3$ is the outer diameter of the encircling unit.

21. The high pressure discharge lamp of claim 20 wherein the electrode rod and encircling unit are composed primarily of tungsten and are integrally fused together, the encircling unit is a tungsten wire coiled around the electrode rod with a thickness between 0.15 mm to 0.30 mm, an outer diameter of the electrode wire is approximately between 0.3 mm to 0.5 mm, and the electrode rod has a total content of impurities of less than 40 ppm.

* * * * *